US006098793A

United States Patent [19]

Jaksha

[11] Patent Number: 6,098,793

[45] Date of Patent: Aug. 8, 2000

[54] PORTABLE DRAWING BOX

[76] Inventor: Steven Jaksha, P.O. Box 427313, San Diego, Calif. 92192-7313

[21] Appl. No.: 09/084,995

[22] Filed: May 28, 1998

[51] Int. Cl.[7] ..... A45C 11/34

[52] U.S. Cl. ..... 206/214; 434/85; 434/88

[58] Field of Search ..... 206/214, 224; 434/85, 87, 88; 312/231

[56] References Cited

U.S. PATENT DOCUMENTS

| | | |
|---|---|---|
| 1,320,537 | 11/1919 | Dimond . |
| 3,091,504 | 5/1963 | Harnsberger . |
| 3,645,595 | 2/1972 | Urquhart et al. . |
| 3,977,744 | 8/1976 | DeWitt . |
| 4,475,650 | 10/1984 | De Fazio, Jr. . |
| 4,600,393 | 7/1986 | Rosenwinkel et al. . |
| 4,604,062 | 8/1986 | Woods . |
| 4,795,210 | 1/1989 | Milat . |
| 4,836,783 | 6/1989 | Harper . |
| 4,892,334 | 1/1990 | Sinclair . |
| 5,409,383 | 4/1995 | Mannino . |
| 5,432,687 | 7/1995 | Lane . |

*Primary Examiner*—David T. Fidei

[57] ABSTRACT

A portable unitary box for use by children in automobiles and similar conveyances including a housing having an interior in which is positioned both a continuous supply of writing paper in roll form, portions of which are successively moved over a supporting surface on the box exterior for sequential use and a removable container for writing instruments such as crayons together with a manually operable paper brake for guiding the strip movement and to permit used strip portions to be sucessively severed from the strip.

5 Claims, 5 Drawing Sheets

15
12
31
28
27
24
26
13
16
19
36
33
38
37
34
C
E
33a
33
36
38a
38
38b
38c
32

PORTABLE DRAWING BOX

FIELD OF THE INVENTION

This invention relates to sketching devices and more particularly to a portable combination writing paper supply and writing instruments packaged in a unitary container.

DESCRIPTION OF THE PRIOR ART

The amusement of children on the part of parents has always been a challenge but nevermore so than when traveling in conveyances such asa automobiles, planes, buses, etc. One very enticing activity has been writing or coloring on paper or the like and is frequently resorted to by parents as a diversion. In this area of activity, the use of crayons is particularly attractive to children.

However, such an activity is fraught with problems considering the multitude of items which must be made available including writing or sketching materials such as crayons, a supply of sketching or writing paper and a surface on which such an activity can be performed.

In addition, purchasers such as parents are usually required to obtain the various necessary materials from different sources with the additional problem of maintaining such materials together for ready availability. Additionally, it is not unusual for an item to be inadvertently misplaced so that an entire assembly is not readily available at the time of use. Also, when the entertainment value has been exhausted, children are prone to fail to reassemble the components parts for subsequent use at a later date.

Furthermore, manufacturers constantly seek cost reduction in the merchandising of products and packaging is an element of costs. Therefore, reduction or elimination of packaging costs would materially increase production and lead to enhanced profits.

J. F. Holtje Pat. No. 2,629,043 issued Feb. 17, 1953 covers an illuminated message case, particularly adapted for the preparation and reading of written messages in the dark.

The S. M. Radzyner Pat. No. 2,980,444 issued Apr. 18, 1961 shows a combination cover and writing table structure.

The J. C. Hackley Pat. No. 3,080,205 issued Mar. 5, 1963 shows a portable writing desk for use in combination with the seat of an automobile.

The McWhite Harnsberger Pat. No. 3,091,504 issued May 28, 1963 shows a recipe cabinet having a drawer for holding recipe cards.

The H. C. Coldren Pat. No. 3,484,952 issued Dec. 23, 1969 shows a transportable tracing device which carries a roll of translucent paper.

The Urquuhart et al Pat. No. 3,645,595 issued Feb. 29, 1972 shows a drawing desk which may be formed from folded cardboard. The desk includes holes for holding a roll of paper.

The D. M. Albright Pat. No. 3,665,612 issued May 30, 1972 shows an apparatus and method for drawing computer flow charts. The housing includes a compartment for containing a roll of paper.

The D. P. Hauser Pat. No. 4,334,644 issued Jun. 15, 1982 shows a dispenser carton for dispensing sheet material.

The Rosenwinkel et al Pat. No. 4,600,393 issued Jul. 15, 1986 shows a drawing toy including a housing supporting a roll of paper and a battery powered light source.

The Cliff Harper Pat. No. 4,836,783 issued Jun. 6, 1989 shows an activity kit which includes a rolled paper dispenser, a writing surface and storage space.

The S. H. Lane Pat. No. 5,432,687 issued Jul. 11, 1995 shows an illuminated writing paper memo system for writing in the dark or low light.

The J. Young Pat. No. 4,984,808 issued Jan. 15, 1991 shows color-crayons and several board games combination sets.

The C. W. Dimond Pat. No. 1,320,537 issued Nov. 4, 1919 shows a portable illuminated sketching or writing desk.

The L. E. Millat Pat. No. 4,795,210 issued Jan. 3, 1989 shows a portable table having a block for supporting crayons for use in automobiles.

The D. R. Pardner Pat. No. 5,360,342 issued Nov. 1, 1994 shows a coloring board for holding a coloring book or paper pad with receptacles for crayons.

The K. K. Krom Pat. No. 4,875,707 issued Oct. 24, 1989 shows a combined crayon and coloring book holder.

The Henry Clover Pat. No. 4,611,994 issued Sep. 16, 1986 shows an artist's sketching device wherein a sketch pad is bound to a back which presents a viewing window directly above the pad.

The Schwartz et al Pat. No. 4,740,161 issued Apr. 26, 1988 shows sound and/or visually stimulating stylus for learning to write.

The J. A. Sullivan Design Pat. No. 329,459 issued Sep. 15, 1992 shows a combined writing instrument and rolled paper dispenser.

The R. A. Tarozzi Design Pat. No. 338,496 issued Aug. 17, 1993 shows a crayon case.

The Dietterich et al Design Pat. No. 354,518 issued Jan. 17, 1995 shows a crayon container.

The H. B. Shattan Design Pat. No. 309,158 issued Jul. 10, 1990 shows a combined crayon container and coloring strip.

The Thomas et al Pat. No. 4,963,048 issued Oct. 16, 1990 shows a retractable writing pen device with note paper.

The prior art demonstrates a product design that requires a store package for shelf display and sales. The prior art products must be packaged with their intrinsic paper rolls and writing utensils and then repackaged so that it can be properly placed on a store shelf. This process takes extra time and costs to the manufacturer for packaging and time to the consumer for the removal of the unnecessary packaging which is not intrinsic to the prior art designs.

SUMMARY OF THE INVENTION

Accordingly, a primary object of this invention is to provide a new and novel entertainment device for children traveling in conveyances such as automobiles and the like.

Another object of this invention is to provide a new and novel portable, unitary kit for children which includes all parts necessary for repeated sketching, writing, coloring and the like.

A further object of this invention is to provide a new and novel unitary assembly of component parts by means of which children while traveling may carry out sketching and coloring activities and at the same time greatly reduce or eliminate loss of such parts.

Still another object of this invention is to provide a coloring package for amusing children while traveling in which all of the component parts are prepackaged for instant use and for easy return to the packaged condition for subsequent use.

A still further object of this invention is to provide a new and novel coloring kit which does not require packaging for sale with attendant reduction in manufacturing costs.

Still another object of this invention is to provide a new and novel coloring box for the entertainment of children while traveling which includes a supply of writing paper for repeated use over long periods, wherein the kit itself inherently provides a writing surface and in which used portions of the paper may be easily severed while permitting unused portions to be neatly and evenly exposed for subsequent use.

Another object of this invention is to provide a new and novel braking device which may be manually operated to retain an end portion of a continuous paper strip for a tear-off operation.

The objects stated above and other related objects are accomplished by the provision of a rigid housing having spaced-apart top and bottom walls, spaced-apart side walls and an access opening at each end with means on the housing for closing the access openings. The top wall has an elongated, transversely extending guide slot and forms a supporting surface for writing. The interior of the housing is provided with a pair of adjacent compartments each associated with a respective one of the access openings. A roll of writing paper in strip form is disposed in one compartment with the free end extending through the guide slot in overlying relationship with the top wall to expose successive portions of the strip for writing. A transversely extending guide member having a serrated, paper strip tearing edge and a flexible tab for manual retaining engagement with the paper strip is disposed on the housing top wall. A secondary housing having spaced-apart side walls, spaced-apart top and bottom walls, a wall at one end defining an interior for the storage of crayons and the like and an access opening at the other end is adapted to be removably positioned in the other compartment of the main housing to provide a unitary drawing box.

DESCRIPTION OF THE PREFERRED EMBODIMENT

Figure 1:
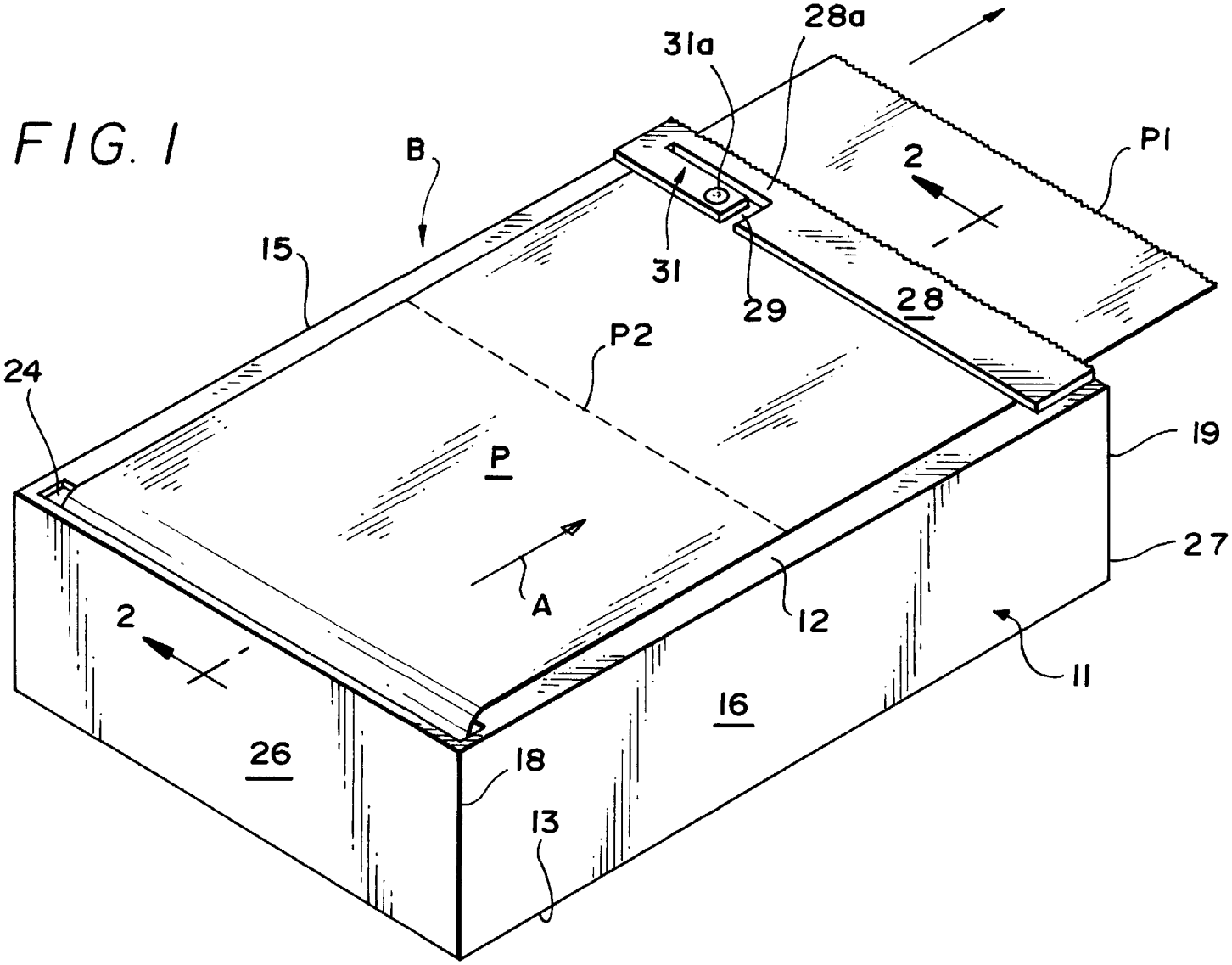
FIG. 1 is a perspective view of the drawing box of the invention.

Referring now to the drawings and to FIG. 1 in particular, there is shown a portable drawing box constructed in accordance with the invention and designated generally by the letter B. The box B is constructed in a rigid form from suitable sheet material such as metal, plastic or the like and comprises a rectangular main housing 11. The housing 11 includes spaced-apart top and bottom walls 12, 13, spaced-apart side walls 15, 16 defining an interior 17 having access openings 18, 19 at each end.

Figure 2:
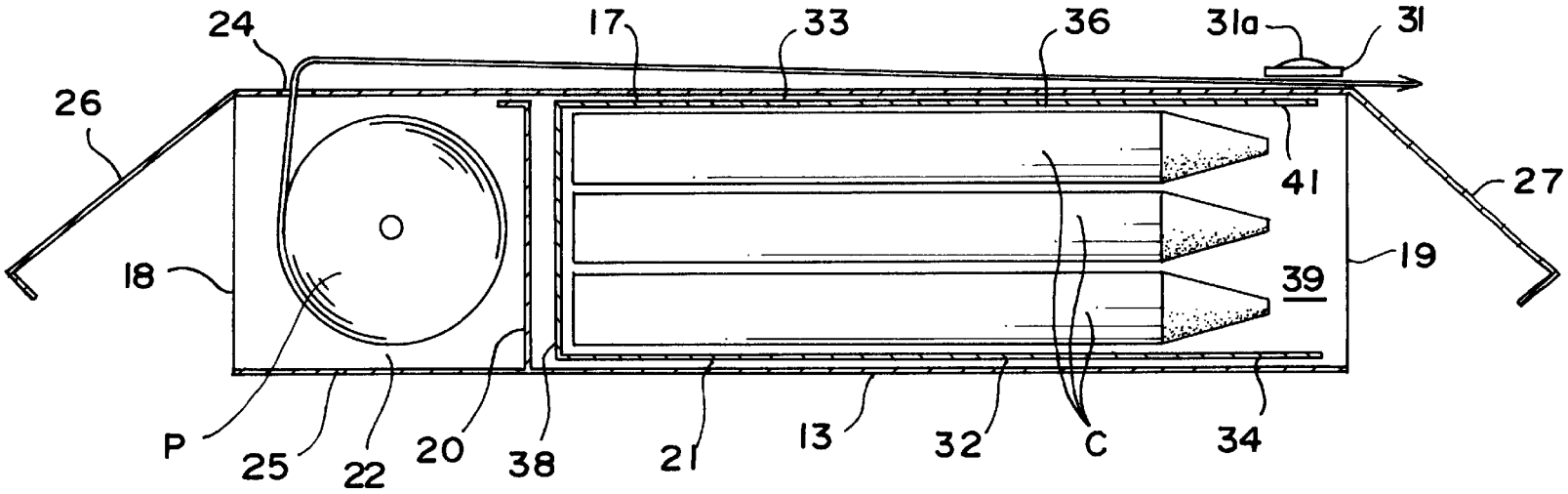
FIG. 2 is a sectional view taken substantially along line 2—2 of FIG. 1 in the direction of the arrows.
Figure 3:
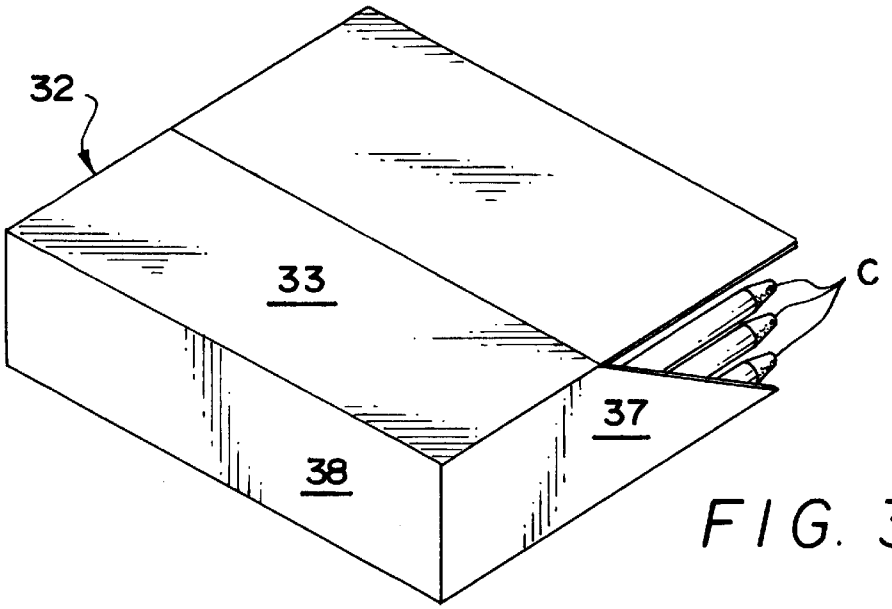
FIG. 3 is a perspective view of the secondary housing incorporated in the box of FIG. 1.

As shown best in FIG. 2, the box interior 17 is divided into a pair of compartments 21, 22 each of which are associated with a respective one of the access openings 18, 19. Preferably, partition means are provided within the housing interior 17 for defining the compartments 21, 22 which, in the illustrated embodiment, comprises a wall 20 formed integrally with the housing 11.

A roll of writing paper in strip form and designated generally by the letter P is disposed within compartment 22 the free end of which extends through an elongated, transversely extending slot 24 in the top wall 12 adjacent the access opening 18. If desired, the strip P may be provided with longitudinally spaced perforations P1, P2, etc. to permit successive portions of the strip to be removed after use.

As can be seen in FIGS. 1, 2, the paper strip P may be advanced in overlying relationship with the top wall 12 in the direction indicated by the arrow A, the top wall serving as a supporting surface when the exposed portion of the strip is to be used for writing, sketching or the like. It will be noted that the access openings 18, 19 are adapted to be closed by flaps 26, 27 respectively preferably formed integrally with the housing 11.

A transversely extending bar member 28 is mounted on the top wall 12 adjacent the access opening 19 and the paper strip P is advanced in the direction of the arrow A in underlying relationship therewith. The bar member 28 is formed of suitable material such as plastic so as to resiliently engage the underlying strip for retaining the exposed strip portion in the selected position.

Figure 7:
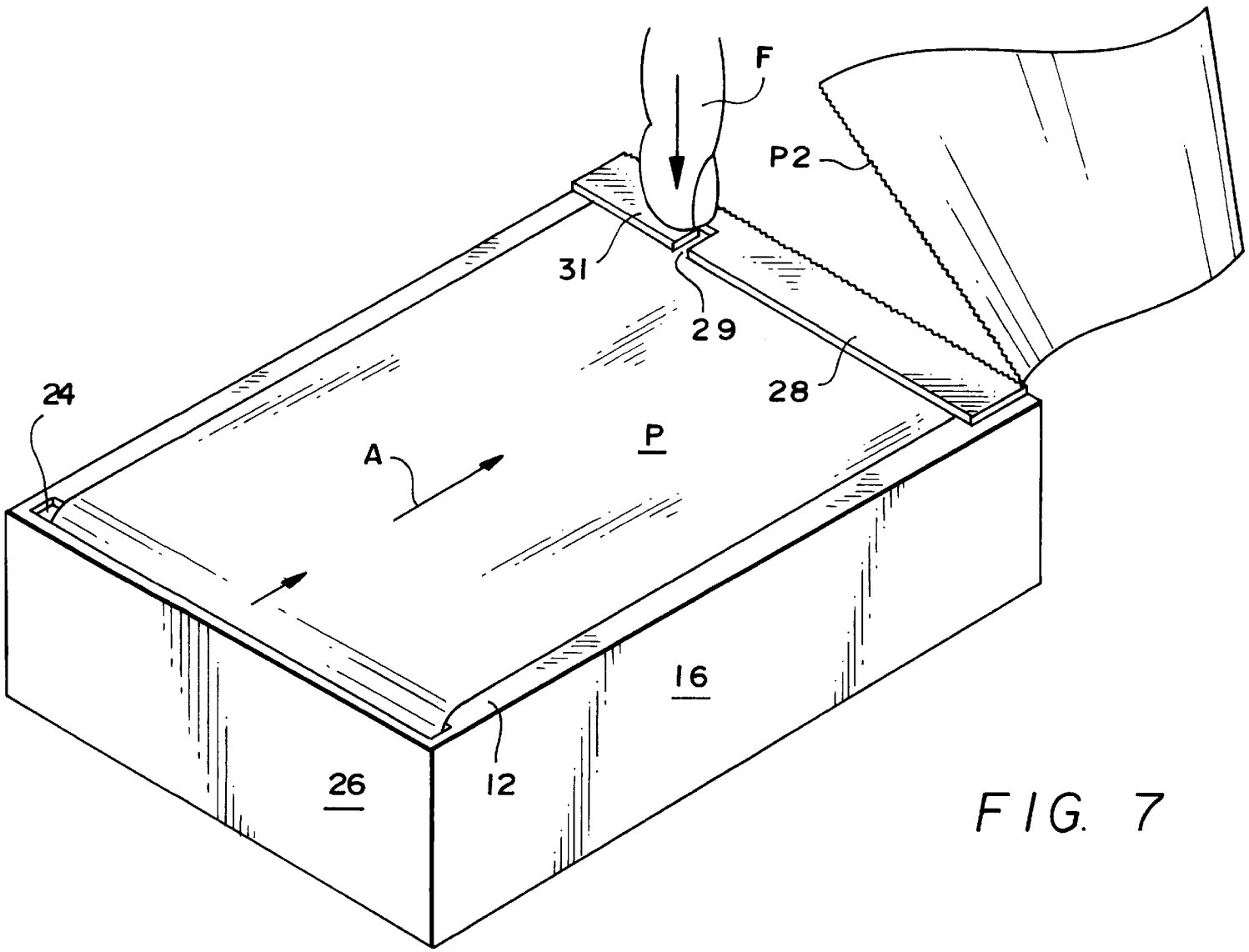
FIG. 7 is a perspective view of the box of FIG. 1 illustrating a paper tearing operation.

The member 28 is provided with a serrated side edge 28*a* against which the used strip portion may be torn away such as along perforations P2 as shown best in FIG. 7. For further retaining the strip P during the tear-off operation, the member 28 is provided with an L-shaped slot 29 adjacent one end which defines a flexible tab 31 having a guide dimple 31*a*. In the relaxed condition, the tab 31 permits the paper strip P to be easily advanced under the bar 28.

Figures 5, 6:
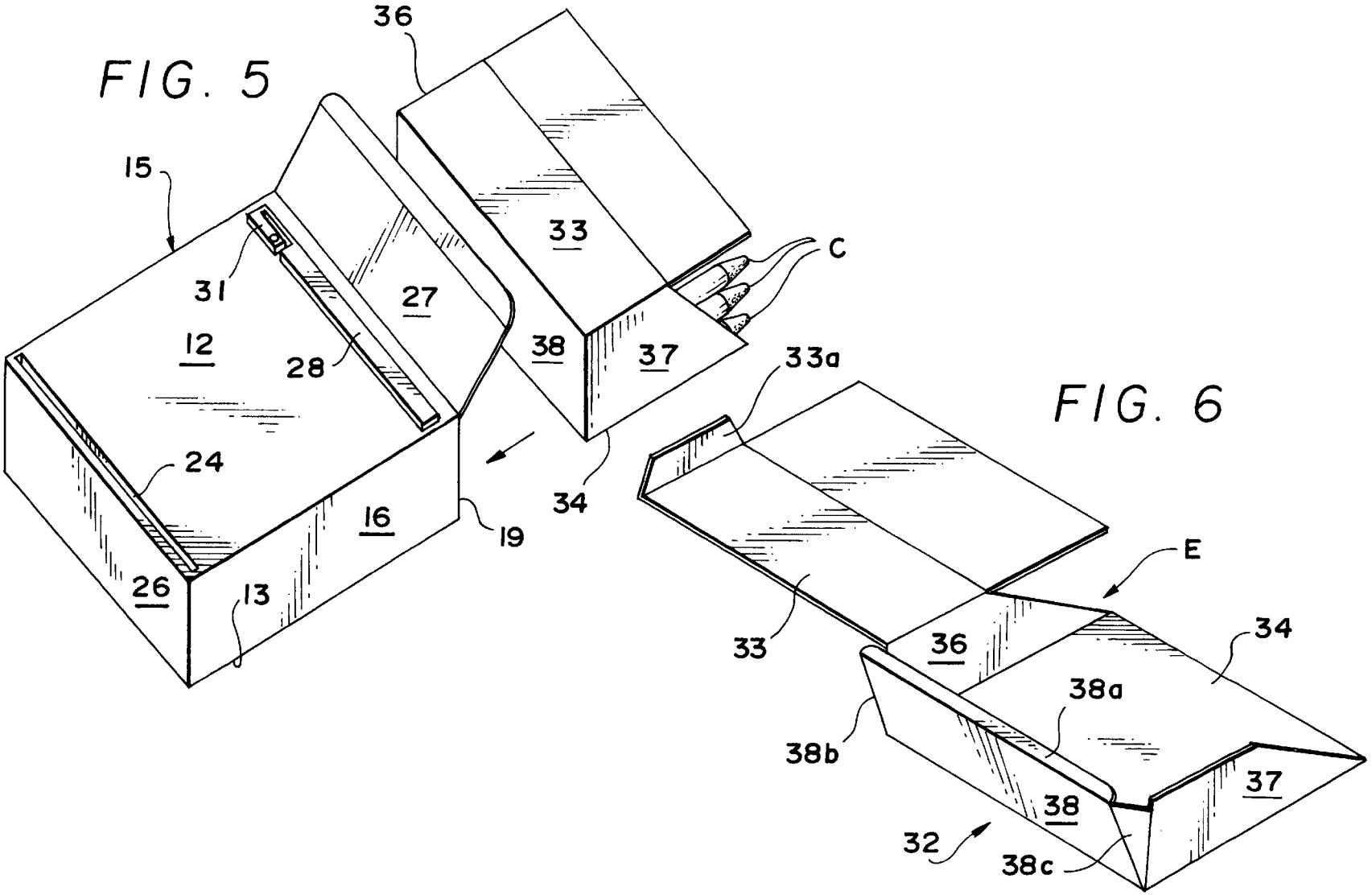
FIG. 5 is a perspective view of box of FIG. 1 with the crayon housing in the withdrawn position.
FIG. 6 is a perspective view of the blank used in the construction of the crayon housing of FIG. 5.

As shown best in FIGS. 2, 5, ready accessibility to writing or sketching instruments such as crayons is obtained by the provision of means for supporting a plurality of such crayons within the main housing 11. More specifically, a secondary housing 32 is provided having spaced-apart top and bottom walls 33, 34, spaced-apart side walls 36, 37 and an end wall 38 defining an interior 39. The secondary housing 32 includes an access opening 41 at the other end to permit the insertion of a plurality of crayons preferably of various colors designated generally by the letter C within the housing interior 39.

The secondary housing 32 is adapted for snug-fitting accommodation within the other compartment 21 of the main housing 11 in a stored condition. Thus, lifting of the closure flap 27 permits access to the crayons C or the secondary housing 32 may be withdrawn from the main housing 11 as shown in FIG. 5 for even more ready access to the crayons C stored therein.

Referring now specifically to FIG. 7, when a used end portion is to be torn from the strip P, the strip is advanced in the direction of the arrow A until the line of perforations P2 coincide with the serrated edge 28*a* of the member 28. Using a finger F guidably positioned on tab 31 by means of the dimple 31*a*, downward pressure is applied to the tab for retaining engagement with the underlying strip P. At this time, the used forward end portion of strip P may be torn away as shown in FIG. 7 and discarded.

Figure 4:
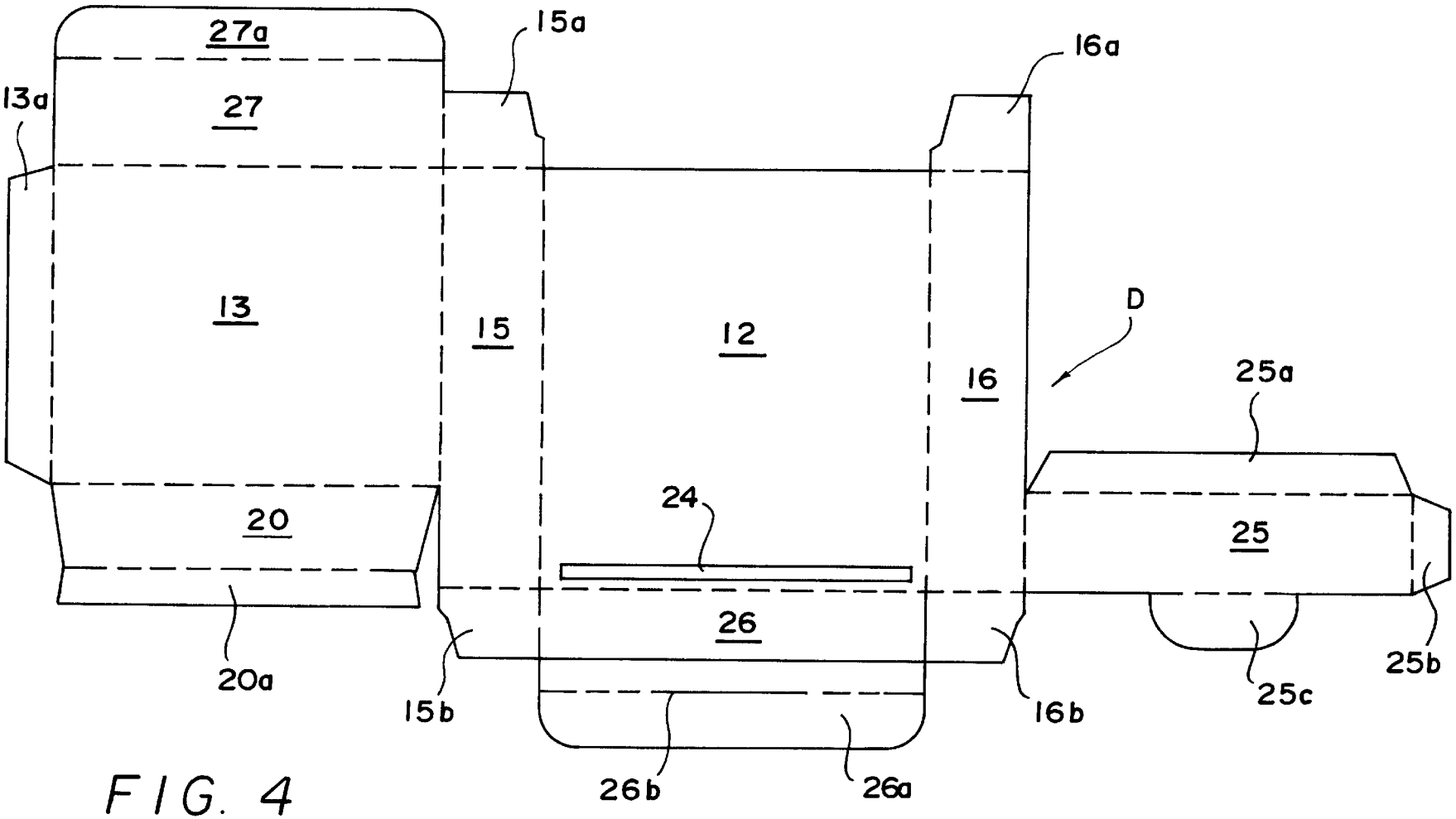
FIG. 4 is a plan view of the blank used in the construction of the box of FIG. 1.

Referring now to FIGS. 4, 6, there are shown one-piece blanks D, E suitably cut and scored from which the main and secondary housings 11, 32 respectively may be formed. As shown in FIG. 4, the blank D includes top and bottom walls 12, 13, side walls 15, 16 and end walls 26, 27, wall 12 containing slot 24. Side walls 15, 16 are provided with corner tabs 15*a*, 15*b* and 16*a*, 16*b* respectively. Bottom wall 13 includes glue tab 13*a* and partition 20 having glue tab 20*a*. End walls 26, 27 include integral tabs 26*a*, 27*a* respectively and slot cut 26*b* is provided along the intersection of tab 26*a* and end wall 26. Wall 25 extends adjacent bottom wall 13 and is provided with glue tabs 25*a*, 25*b* and tab 25*c*. Suitable fold lines are provided as shown.

FIG. 6 shows the integrally formed blank E for the secondary housing 32. The blank E comprises top and bottom walls 33, 34, side walls 36, 37 and end wall 38 provided with glue tab 38*a* and corner tabs 38*b*, 38*c*. Top wall 33 includes glue tab 33*a*.

As referred to heretofore, the box B is displayed for sale in the form shown in FIGS. 1, 2, no external packaging being required. In this form, the paper strip P is advanced over the housing top wall 12 and under the bar 28 to expose a portion of the strip P for writing and/or sketching. The secondary housing 32 may be withdrawn from the main housing 11 after lifting the end flap 27 for ready access as shown in FIG. 5. After use of the exposed strip portion, tear-off of the used strip portion is accomplished as previously described to expose the next strip portion between the perforations for use.

What is claimed is:

1. A portable drawing box for children comprising, in combination, a rigid main housing of sheet material having spaced-apart top and bottom walls and spaced-apart side walls defining an interior and an access opening at each end, said top wall forming a supporting surface for writing, said housing interior having a pair of adjacent compartments each associated with a respective one of said access openings, a roll of writing paper in strip form disposed within one of said compartments, said top wall having an elongated, transversely extending guide slot adjacent said one said one of said compartments for advance of said paper strip from said roll into overlying relationship with said top wall to expose successive portions of said strip for writing, a transversely extending retaining member mounted on said housing top wall adjacent an other of said compartments for retaining said paper strip in said overlying relationship with said top wall and having a tearing edge for said paper strip, means for supporting a plurality of writing utensils in said other of said compartments and means for closing each access opening.

2. A drawing box in accordance with claim 1 wherein said tearing edge comprises a serrated edge.

3. A drawing box in accordance with claim 1 including a tab of flexible material on said retaining member, said tab being manually movable from a relaxed condition into gripping engagement with said paper strip during tearing of said paper strip on said retaining member.

4. A drawing box in accordance with claim 1 wherein said means for supporting said plurality of writing utensils in said other compartment comprises a secondary housing having spaced-apart top and bottom walls, spaced-apart side walls and an end wall at one end defining an interior, said second housing having an access opening at the other end for insertion of writing utensils, means for closing said secondary housing access opening, said secondary housing adapted to be snugly accommodated removably within said other compartment through said other compartment access opening to provide a unitary drawing box.

5. A drawing box in accordance with claim 1 including partition means within said main housing interior for defining said pair of adjacent compartments.

* * * * *